US008764214B2

(12) United States Patent
Chen

(10) Patent No.: US 8,764,214 B2
(45) Date of Patent: Jul. 1, 2014

(54) HANDY RIVETER DEVICE

(76) Inventor: Yi-Jhen Chen, Taichung (TW)

( * ) Notice: Subject to any disclaimer, the term of this patent is extended or adjusted under 35 U.S.C. 154(b) by 211 days.

(21) Appl. No.: 13/568,074

(22) Filed: Aug. 6, 2012

(65) Prior Publication Data

US 2014/0036481 A1 Feb. 6, 2014

(51) Int. Cl.

| | |
|---|---|
| ***B21J 15/38*** | (2006.01) |
| ***B25B 33/00*** | (2006.01) |
| ***B21J 15/04*** | (2006.01) |
| ***B21J 15/32*** | (2006.01) |
| *B25B 31/00* | (2006.01) |

(52) U.S. Cl.

CPC ..... *B21J 15/043* (2013.01); *B25B 31/00* (2013.01); *B21J 15/32* (2013.01)

USPC ..... 362/119; 29/243.521

(58) Field of Classification Search

CPC ..... B25B 31/00; B21J 15/043; B21J 15/32

USPC ..... 362/119; 29/243.521; 227/53

See application file for complete search history.

(56) References Cited

U.S. PATENT DOCUMENTS

| | | | | |
|---|---|---|---|---|
| 3,302,444 | A * | 2/1967 | Elliott | 29/243.528 |
| 3,886,782 | A * | 6/1975 | Miyamoto | 29/243.528 |
| 4,537,343 | A * | 8/1985 | Johansson | 227/120 |
| 4,805,824 | A * | 2/1989 | Erickson | 227/120 |

* cited by examiner

*Primary Examiner* — David V Bruce

(57) ABSTRACT

A handy riveter device includes a fastening screw, a casing, a handlebar and a pulling member. The casing has a left cover and a right cover connecting to each other. The casing has a receiving space, an attaching face and a top face. A hole is opened on the casing and communicating with the receiving space. The pulling member is slidably assembled into the receiving space. The pulling member has an engaging groove and a resisting block. An elastomer abuts against the pulling member and the receiving space. The handlebar is assembled into the casing partially and a pivoting rod passes through the casing and the handlebar. Under this arrangement, a user assembles the fastening screw into an articles and the handle bar and sets the handy riveter device on the articles and pushes the handlebar to fasten the articles via the fastening screw.

8 Claims, 10 Drawing Sheets

HANDY RIVETER DEVICE

BACKGROUND OF THE INVENTION

1. Field of the Invention

The present invention relates to a riveter device, and more particularly to a handy riveter device.

2. Description of Related Art

A conventional riveter device comprises a fixing bar pivoting on an operating bar, an engaging slice and a spring via a first pivoting rod so that the operating bar has an appropriate restoring force after being pressed, the fixing bar having an axial hole and a transverse hole opened thereon, the axial hole being adjacent to a transverse hole, the operating bar having a engaging portion, two axial engaging holes opened on the engaging portion and two transverse engaging holes opened on the engaging slice to fasten a handle bar so that a second pivoting rod, which is behind the handle bar, is selectively engaged with one of the axial engaging hole and the transverse engaging hole of the operating bar so as to adjust the conventional riveter device in a standing mode or a laying mode, a stretching spring connected between the operating bar and the engaging slice so that the handle bar is fastened because of the axial engaging hole and the transverse engaging hole of the engaging slice, the handle bar having two half-cut sandwiching block, an abutting block and a compressing spring defined therein, the sandwiching blocks both having a passing hole opened at a center part thereof, the passing hole having an engaging structure to engage with a fastening bolt, the handle bar being passing through a base, the base having an upper block and a bottom block defined at a rear end thereof for rotatably locking the base on the fixing bar, the base having a ring defined at a front end thereof so that the base is screwed into the fixing bar because of the ring, the base having an adjusting cylinder assembled at the front end thereof, a fixing cylinder being screwed into the base, the fixing cylinder having an attaching face for abutting against a plurality of articles which are stacked with each other, the base having a tilting hole opened at a center of the base therethrough, two half-cut moving blocks being inserted into the tilting hole, the moving blocks having a penetrating hole opened at a center between the moving blocks therethrough for inserting the fastening bolt into the handle bar via the penetrating hole, the moving blocks having a restoring member defined at a wall thereof so as to adjust a distance between the adjusting cylinder and the moving blocks for enlarging or reducing the penetrating hole of the moving blocks. Under this arrangement, firstly, a user assembles one end of the fastening bolt into the articles, and inserts another end of the fastening bolt into the handle bar via the penetrating hole, then the user put the attaching face of the riveter device on the surface of the articles to abut against the articles, and then the user pulls the operating bar of the conventional riveter device toward the fixing bar so as to fasten the fastening bolt between the articles and to fasten the articles together. Moreover, each of the fastening bolts with difference diameters is able to be set into the handle bar because the distance between the adjusting cylinder and the moving blocks is adjustable.

Another conventional riveter device comprises a case, a cylinder combined to a front part of an outer portion of the case, an abutting head combined to a front part of the cylinder and the abutting head being used to set the fastening bolt, the abutting head having an attaching face to abut against the articles, the case having a handlebar extended at a rear part therefrom, an angle between the handlebar and the cylinder being approximately 90 degree, a sliding block having two half-cut sandwiching blocks defined at a front part thereof, the sliding block passing into the cylinder, a clutch defined between the handlebar and the base, an upper part of the clutch pivoted on the case and abutting against a spring, a connecting member defined between the handlebar and a rear part of the sliding block, the connecting member pivoted on the case. Under this arrangement, firstly, the user assembles one end of the fastening bolt into the articles, and inserts another end of the fastening bolt into the handle bar, then the user attaches the attaching face of the riveter device to the surface of the articles, and then the user pulls the clutch of the riveter device so as to to fasten the fastening bolt between the articles and to fasten the articles together.

However, the conventional riveter devices have two disadvantages as following.

Firstly, the area of the attaching face between the riveter device and the articles is too small to stably operate the conventional riveter devices when the attaching face of the conventional riveter devices is abutted against the articles.

Secondly, operating the conventional riveter devices is inconvenient due to the handle bar is pushed from the articles toward the fixing bar. In this way, the riveter devices cannot attach to the surface of the articles well and the position of the riveter devices may shift so that the fastening bolt cannot be vertically inserted into the articles.

The present invention has arisen to mitigate and/or obviate the disadvantages of the conventional.

SUMMARY OF THE INVENTION

The main objective of the present invention is to provide a handy riveter device.

To achieve the objective, a handy riveter device comprises a fastening screw, a casing, a handlebar and a pulling member, the casing having a left cover and a right cover which are connected to each other, the casing having a receiving space defined therein, the casing having an attaching face defined at a front side thereof, the attaching face having a limiting opening opened at a top end thereof, the casing having a top face defined at a top plane thereof, the top face having a positioning opening at a front end thereof, the limiting opening, the positioning opening and the receiving space communicating with each other, a hole opened on a rear side of the casing, the hole communicating with the receiving space of the casing, one end of the handlebar assembled into the casing, a pivoting rod passing through the casing and the handlebar so that the handlebar is pivoted on the casing via the pivoting rod, another end of the handlebar extended out from the receiving space via the hole of the casing, the pulling member slidably assembled into the receiving space, a front end of the pulling member having an engaging groove, the engaging groove corresponding to the limiting opening, a resisting block extruded on a bottom side the pulling member, the resisting block corresponding to one end of the handlebar, one end of the handlebar which is in the receiving space abutting against the resisting block, the receiving space having an elastomer assembled therein, one end of the elastomer abutting against the pulling member, and another end of the elastomer abutting against an inner wall of the receiving space. Wherein, one end of the handlebar which is assembled in the receiving space is defined as a pushing part; wherein when the pushing part is moved by pushing the handlebar, the pushing part pushes against the resisting block to smoothly move the pulling member backward; the pulling member has a receiving room opened at a top side thereof; the receiving room has a stopping block defined therein; one end of the elastomer gets into the receiving room and abuts against the stopping block; the receiving space has a torsion spring assembled therein; one end of the torsion spring abuts against the inner wall of the receiving space, and another end of the torsion spring abuts against an inner side of the handlebar; two limiting extrusions are respectively protruded from the left cover and the right cover; the two limiting extrusion correspond to the bottom side of the pulling member; at least one locking part is defined on a periphery of the casing so that the left cover is combined with the right cover to assemble the casing quickly; the casing has a limiting groove defined on the attaching face; the limiting groove has a rail opened at a bottom thereof; a combining block is assembled to the limiting groove; the combining block has a combining part protruded thereon; the combining part corresponds to the rail, and the combining part is slidably assembled onto the rail so that the combining block is movable relative to the limiting groove via the rail and the combining part; a lightening device is assembled on the casing; the lightening device is adjacent to the attaching face and the limiting opening.

Further benefits and advantages of the present invention will become apparent after a careful reading of the detailed description with appropriate reference to the accompanying drawings.

DETAILED DESCRIPTION OF THE INVENTION

Figure 1:
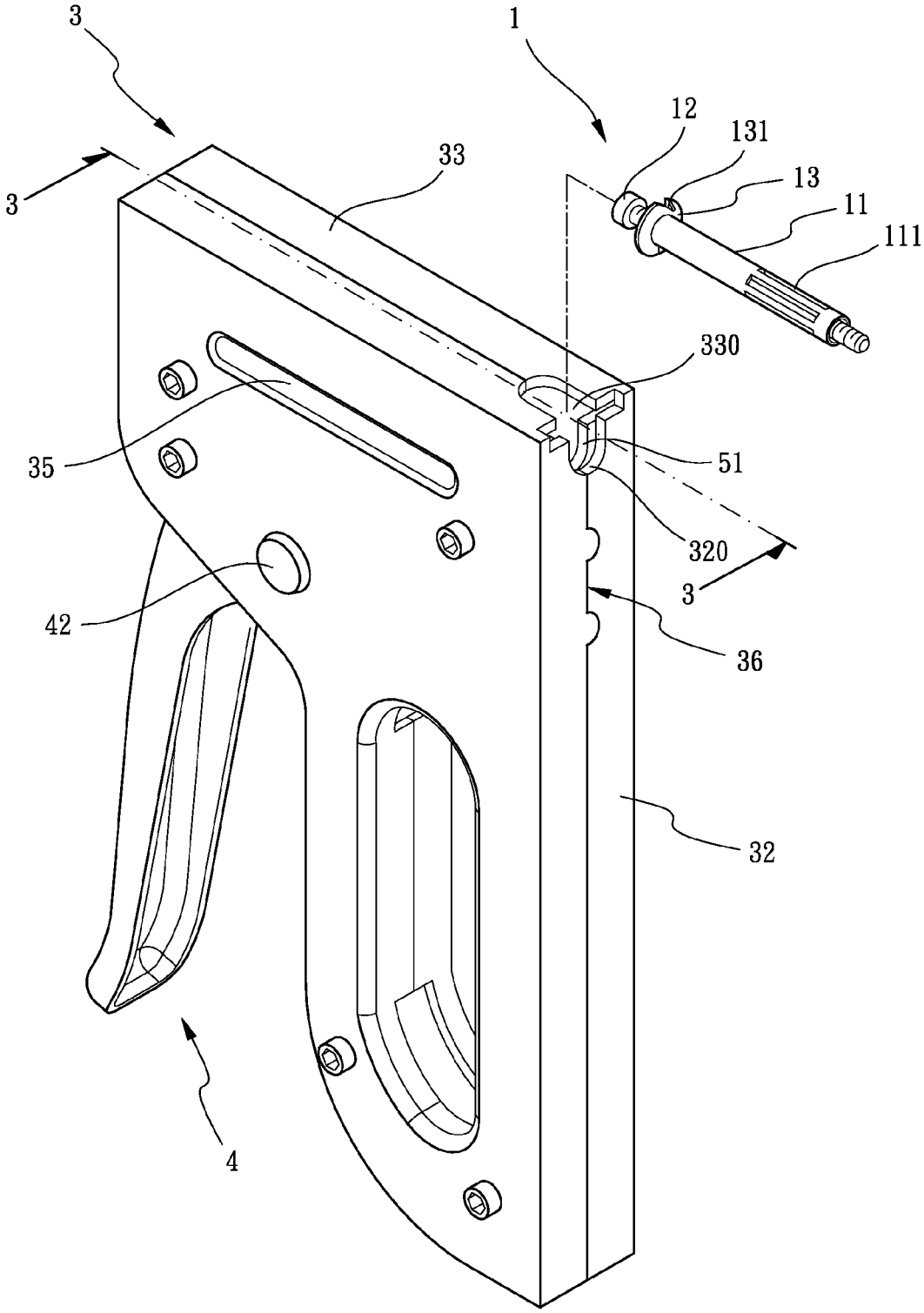
FIG. 1 is a perspective view of a handy riveter device of the present invention.
Figure 2:
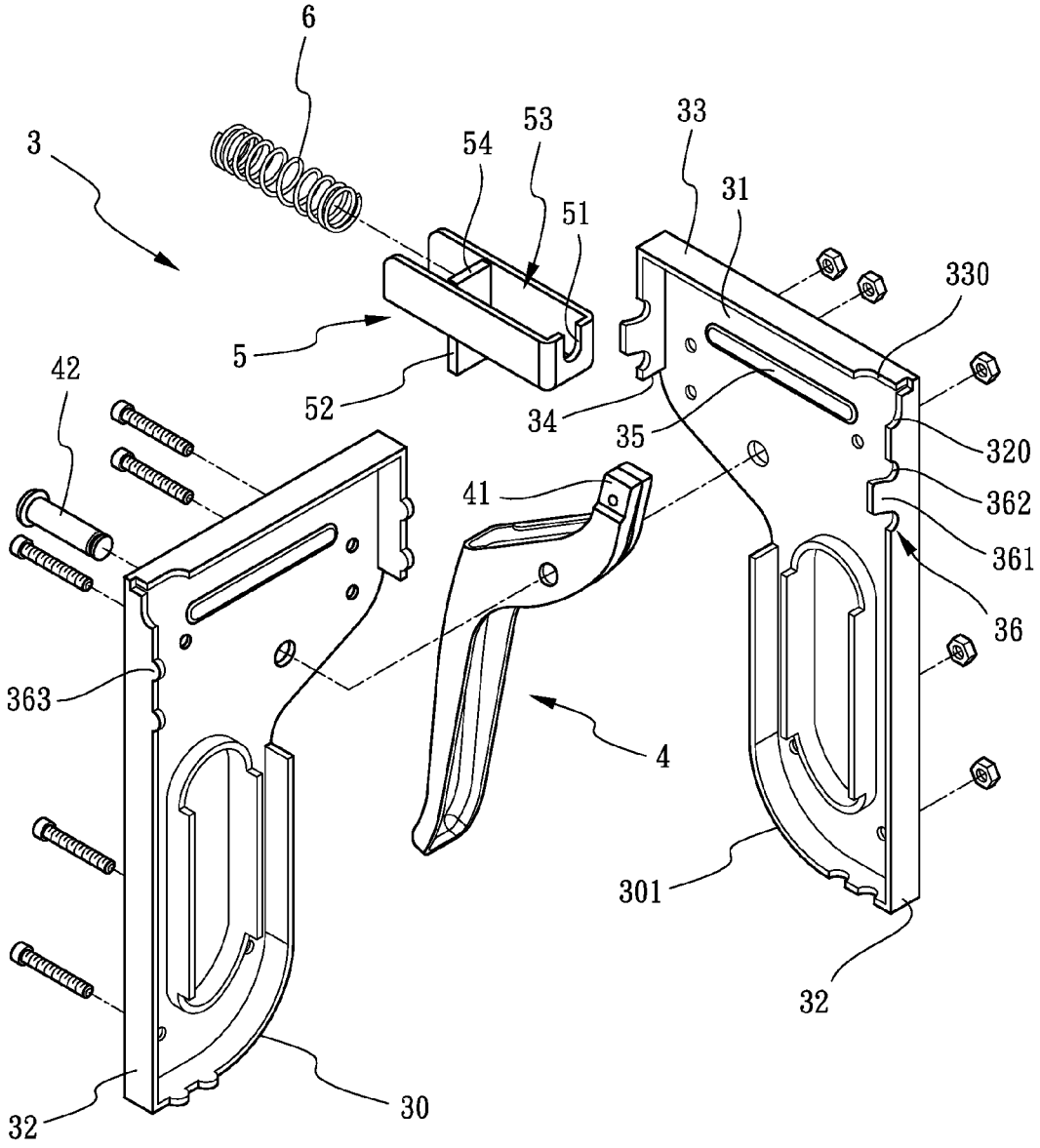
FIG. 2 is an exploded view of the handy riveter device.
Figure 3:
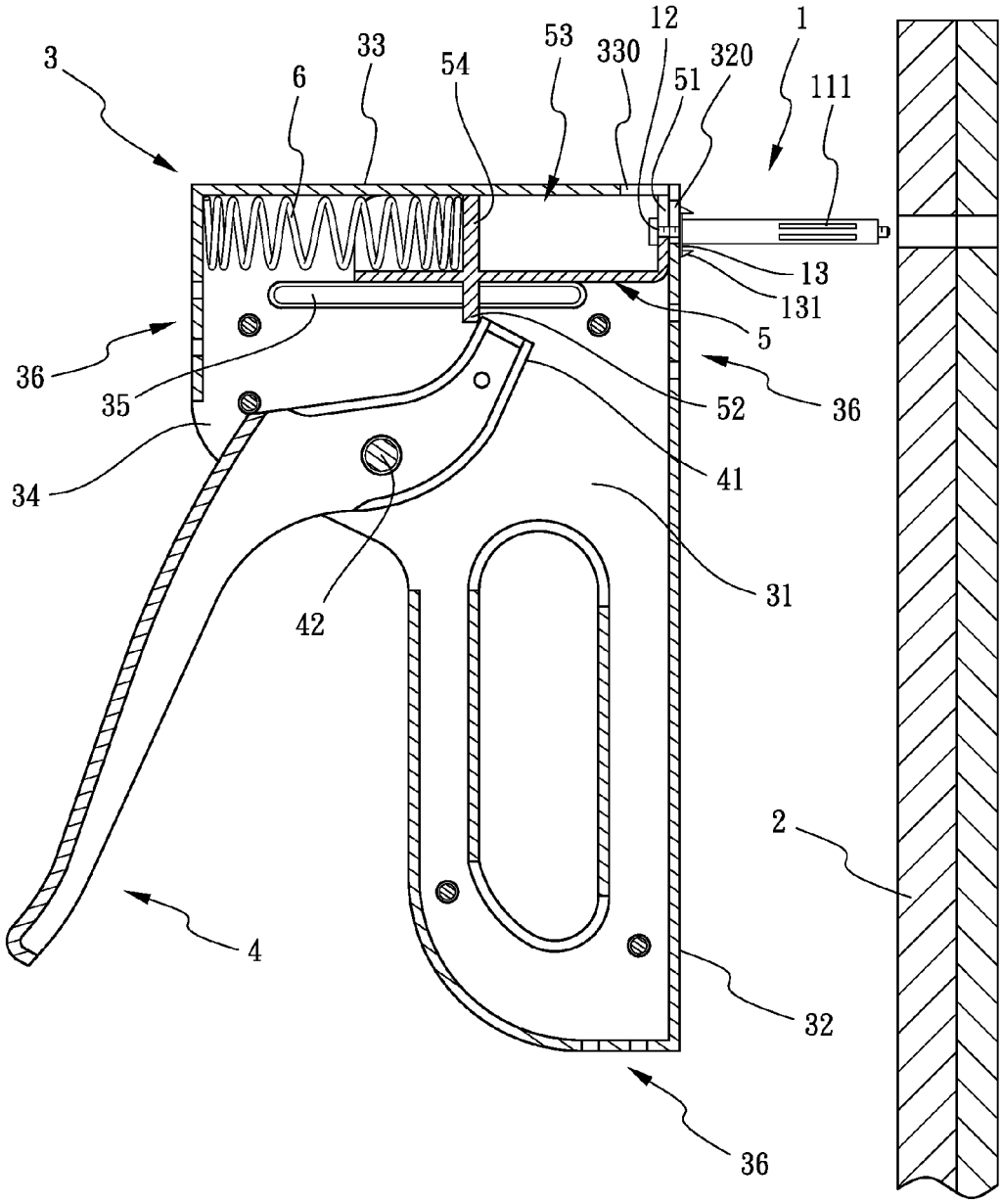
FIG. 3 is a cross-sectional view along line 3-3 in FIG. 1.

Referring to FIGS. 1-2, a handy riveter device in accordance with the present invention is used to tightly fasten a plurality of articles 2 which are stacked with each other. The handy riveter device comprises a fastening screw 1, a casing 3, a handlebar 4 and a pulling member 5.

The casing 3 comprises a left cover 30 and a right cover 301 which are connected to each other. The casing 3 has a receiving space 31 defined therein. The casing 3 has an attaching face 32 defined at a front side thereof. The attaching face 32 is used to be abutted against the articles 2. The attaching face 32 has a limiting opening 320 opened at a top end thereof. The casing 3 has a top face 33 defined at a top plane thereof. The top face 33 has a positioning opening 330 at a front end thereof. The limiting opening 320, the positioning opening 330 and the receiving space 31 communicate with each other. A hole 34 is opened on a rear side of the casing 3. The hole 34 communicates with the receiving space 31 of the casing 3.

One end of the handlebar 4 is assembled into the casing 3. A pivoting rod 42 passes through the casing 3 and the handlebar 4 so that the handlebar 4 is pivoted on the casing 3 via the pivoting rod 42. Another end of the handlebar 4 is extended out from the receiving space 31 via the hole 34 of the casing 3.

The pulling member 5 is slidably assembled into the receiving space 31. A front end of the pulling member 5 has an engaging groove 51. The engaging groove 51 corresponds to the limiting opening 320. A resisting block 52 is extruded on a bottom side the pulling member 5. The resisting block 52 is corresponding to one end of the handlebar 4. One end of the handlebar 4 which is in the receiving space 31 abuts against the resisting block 52. The receiving space 31 has an elastomer 6 assembled therein. One end of the elastomer 6 abuts against the pulling member 5, and another end of the elastomer 6 abuts against an inner wall of the receiving space 31 (the above description is enough to perform the broad embodiment of the present invention.).

Referring to FIGS. 2-6, in order to smoothly push the resisting block 52 to move the pulling member 5 by operating the handlebar 4, one end of the handlebar 4 which is assembled in the receiving space 31 is defined as a pushing part 41. When the pushing part 41 is moved by pushing the handlebar 4, the pushing part 41 pushes against the resisting block 52 to smoothly move the pulling member 5 backward.

Under this arrangement, a user operates the present invention via the following steps as shown in FIGS. 3-6.

Firstly, the user makes the fastening screw 1 pass through the articles 2 which are stacked with each other so that two ends of the fastening screw 1 are respectively exposed out from two sides of the articles 2. One end of the fastening screw 1 is assembled into the engaging groove 51 of the pulling member 5. The fastening screw 1 has a sleeve 11 and a bolt 12. The sleeve 11 is passed through by the bolt 12 for connecting the bolt 12 therein. The sleeve 11 has a plurality of fastening part 111 defined at one end thereof. The fastening parts 111 are uniformly assembled around the sleeve 11. The sleeve 11 has a shoulder 13 extruded from another end thereof. The shoulder 13 has at least one pin 131 extruded from an outer periphery thereof (the detail of the sleeve 11 is well-known of the related art so that it would not be further described in the present invention.). The pin 131 is corresponding to the fastening parts 111. The pin 131 is used to fasten the fastening screw 1 into the articles 2. Two ends of the bolt 12 are respectively exposed out from the two ends sleeve 11. The bolt 12 is inserted into the pulling member 5; then an inner periphery of the shoulder 13 of the sleeve 11 is abutted against the attaching face 32; finally, the attaching face 32 of the casing 3 is abutting against the articles 2.

Secondly, the user frontward presses the handlebar 4 along the hole 34 and toward the attaching face 32 gradually, and then the pushing part 41 of the handlebar 4 pushes the resisting block 52 to move the pulling member 5. Moreover, the bolt 12 of the fastening screw 1 is engaged with the engaging groove 51 of the pulling member 5. As a result, when the pulling member 5 moves from the limiting opening 320 toward the elastomer 6, the bolt 12 is pulled by the motion of the member 5 simultaneously so that the bolt 12 also moves toward the elastomer 6. In addition, the bolt 12 is connected to the sleeve 11, so that when the bolt 12 is pulled by the motion of the member 5, the fastening parts 111 of one end of the sleeve 11 is extruded by the motion of the bolt 12 (The fastening parts 111 of the sleeve 11 are extrudable in the present invention.). Furthermore, the user presses the handlebar 4 to move the pulling member 5 to abut against the elastomer 6 so that an elastic force is formed by the elastomer 6; conversely, when the user releases the handlebar 4, the elastic force of the elastomer 6 is released. Under this arrangement, when the user presses the handlebar 4 repeatedly, one end of the sleeve 11 which has the fastening parts 111 is extruded gradually by the motion of the bolt 12 so that the stacked articles 2 are sandwiched between the shoulder 13 and the extruded fastening parts 111 of the sleeve 11.

Finally, after the sleeve 11 fastens the stacked articles 2, the bolt 12 of the fastening screw 1 is detached from the sleeve 11 so as to make the surface of the articles 2 be smooth.

According to the operation steps mentioned above, the first step is alternated by another way described as the following. Instead of having the fastening screw 1 passing through the stacked articles 2, the user passes the head of the bolt 12 of the fastening screw 1 through the positioning opening 330 of the casing 3 and engages the head of the bolt 12 with the engaging groove 51 of the pulling member 5. Therefore, the bolt 12 is located between the engaging groove 51 and the limiting opening 320 so that the user holds the casing 3 to make the fastening screw 1 aim to the stacked articles 2 to penetrate the articles 2.

Figure 4:
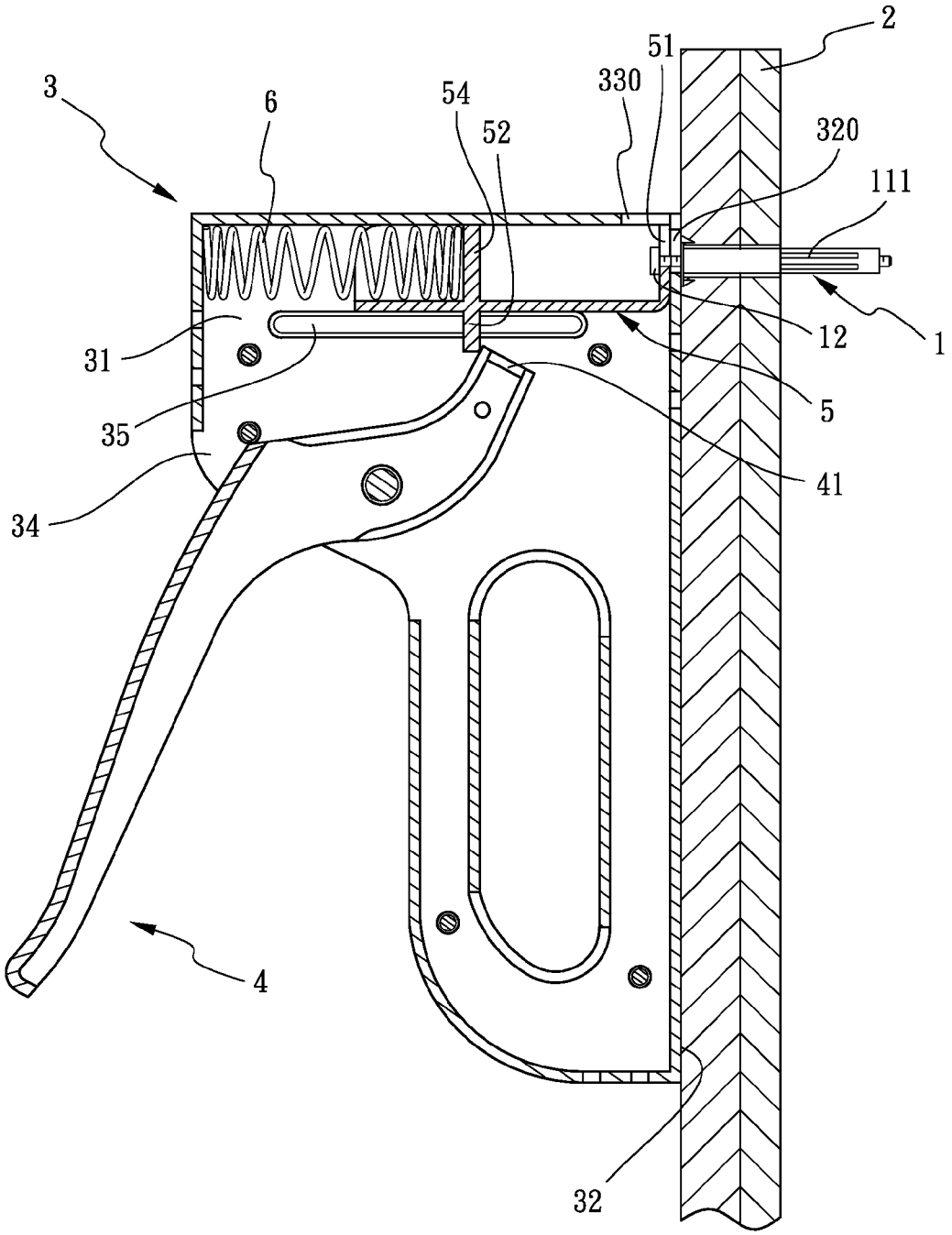
FIG. 4 is a cross-sectional view along line 3-3 in FIG. 1 for showing one end of a bolt of an fastening screw being inserted into a positioning opening of the present invention, and another end of the bolt being passing through articles.
Figure 5:
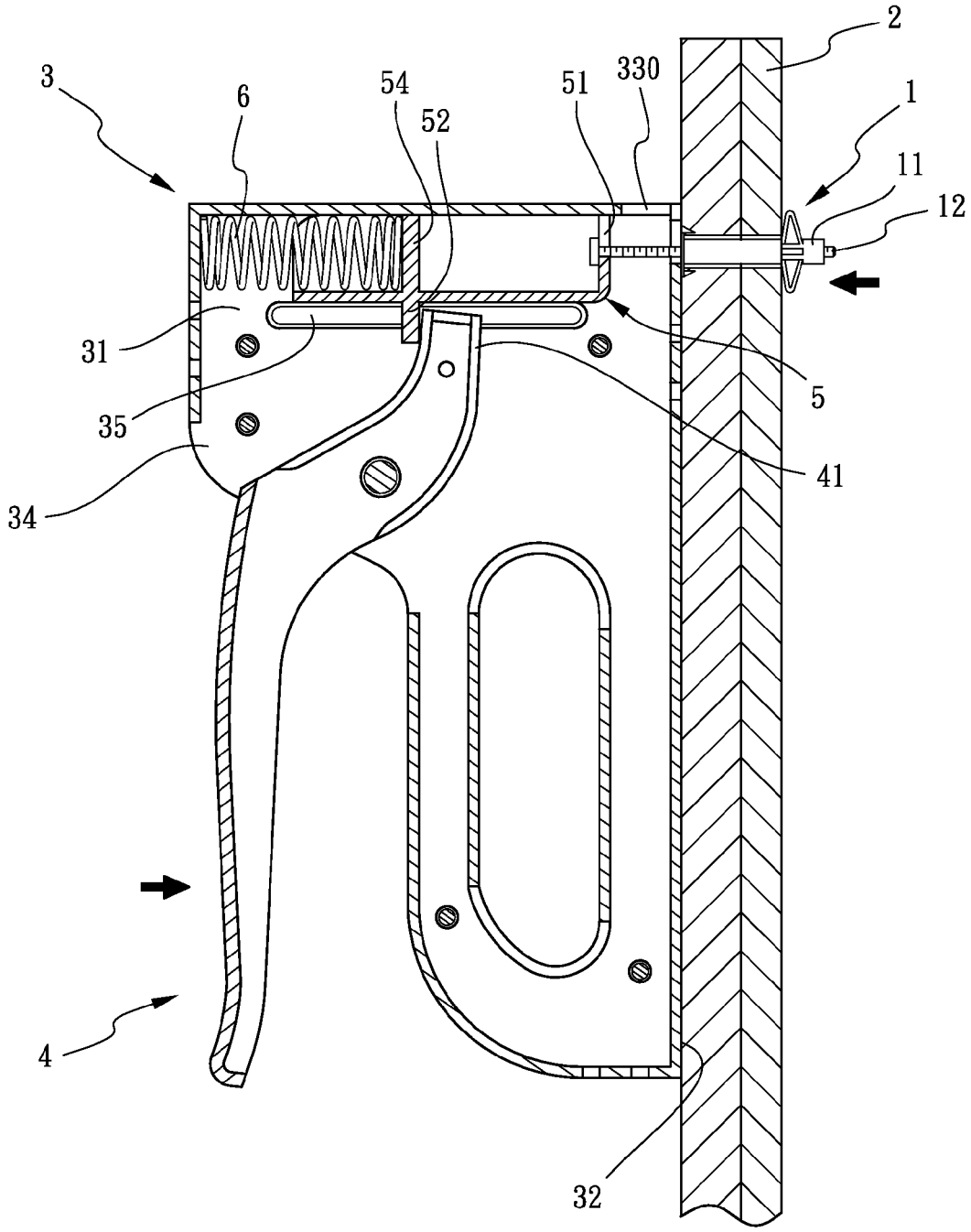
FIG. 5 is a cross-sectional view for showing a user presses a handlebar to compress a sleeve of the fastening screw to deform a fastening part of the sleeve.
Figure 6:
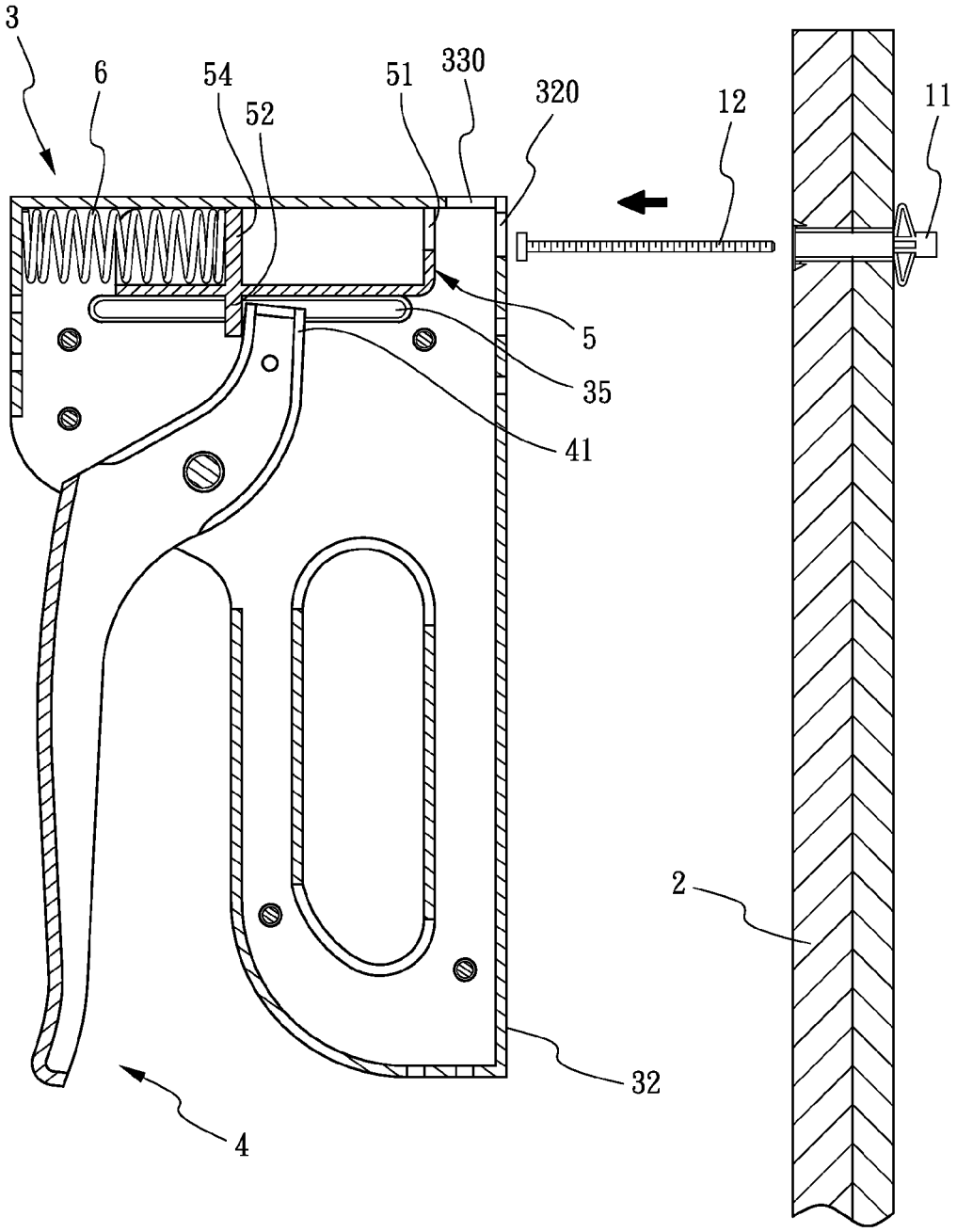
FIG. 6 is a cross-sectional view for showing the bolt being separated from the fastening screw after the sleeve of the fastening screw is deformed.

Referring to FIG. 4 and FIG. 5, in order to ensure the elastomer 6 is stably abutting against the pulling member 5 and the inner wall of the receiving space 31, the pulling member 5 has a receiving room 53 opened at a top side thereof. The receiving room 53 has a stopping block 54 defined therein. One end of the elastomer 6 gets into the receiving room 53 and abuts against the stopping block 54, and another end of the elastomer 6 abuts against the inner wall of the receiving space 31 so that the elastomer 6 is positioned in the receiving room 53. In addition, the receiving room 53 of the pulling member 5 further receives the head of the bolt 12 of the fastening screw 1.

Referring to FIGS. 1-6, in order to keep the pulling member 5 moving smoothly and straightforwardly, two limiting extrusions 35 are respectively protruded from the left cover 30 and the right cover 301. The two limiting extrusion 35 corresponds to the bottom side of the pulling member 5 and recess from an outer surface of the casing 3 toward the receiving space 31. The two limiting extrusions 35 are parallel with each other. Under this arrangement, the two limiting extrusions 35 restrict the pulling member 5 to move smoothly and straightforwardly.

Referring to FIGS. 1-6, at least one locking part 36 is defined on a periphery of the casing 3. The locking part 36 has a locking slice 361 protruded from the right cover 301. Two ends of the locking slice 361 respectively have two recessions 362 defined thereon. The left cover 30 has a least one protrusion 363. The amount of the protrusions 363 is the same as the recessions 362 and each protrusions 363 corresponds to each corresponding recessions 362 (In this embodiment, the locking slice 36 is defined on the right cover 301, and the protrusion 363 is defined on the left cover 30.). Under this arrangement, the user engages the recession 362 of the right cover 301 with the protrusion 363 of the left cover 30 so that the left cover 30 is combined with the right cover 301 to assemble the casing 3 quickly (The method of combining the left cover 30 with the right cover 301 is not limited by the present invention. In other wards, sticking, locking or other methods might be used to combine the left cover 30 with the right cover 301.).

Figure 7:
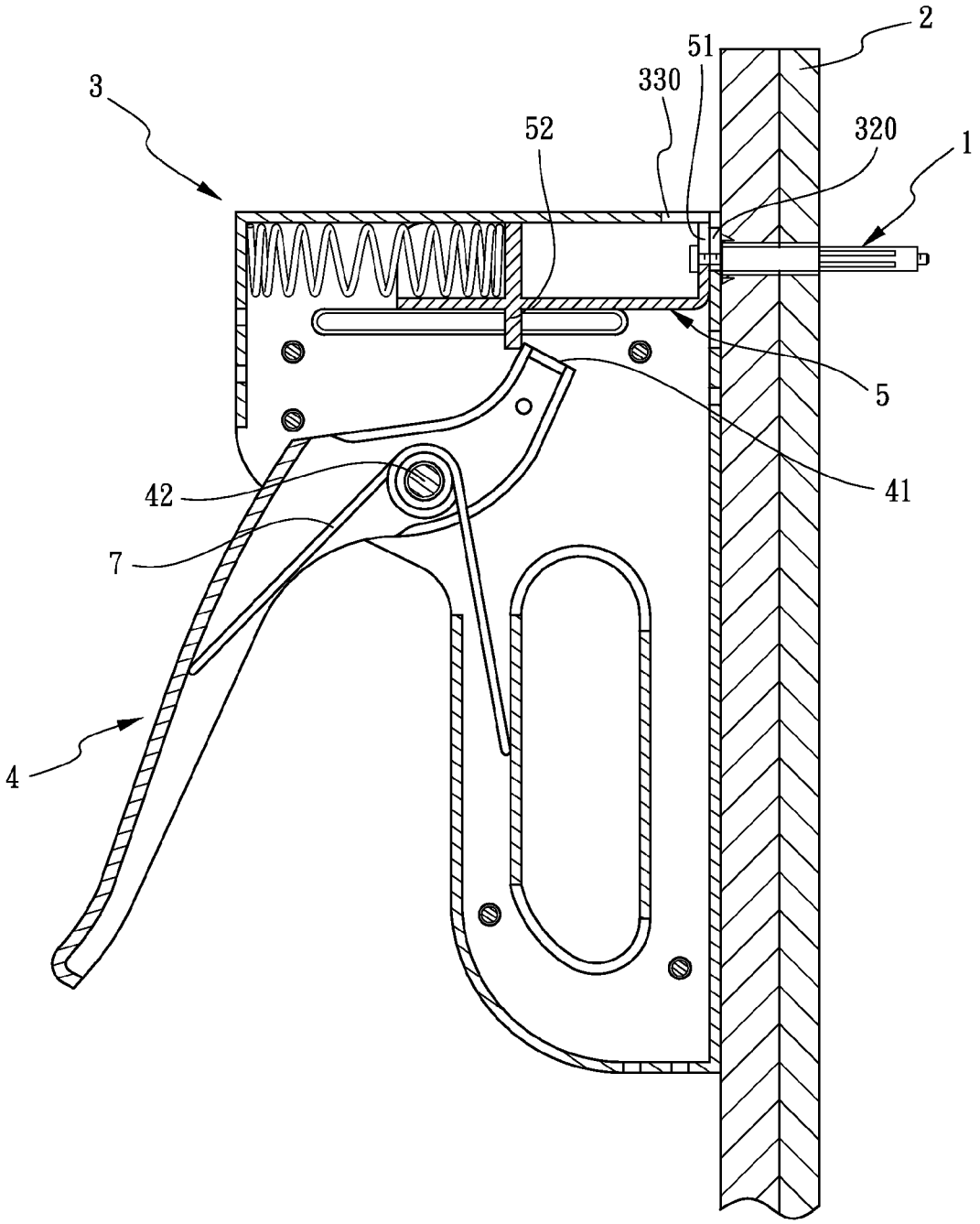
FIG. 7 is a cross-sectional view of a second embodiment of the present invention.

Referring to FIG. 7, the receiving space 31 has a torsion spring 7 assembled therein. One end of the torsion spring 7 abuts against the inner wall of the receiving space 31, and another end of the torsion spring 7 abuts against an inner side of the handlebar 4. Under this arrangement, a restoring force of the torsion spring 7 makes the handlebar 4 be quickly restored when the handlebar 4 is released by the user.

Figure 8:
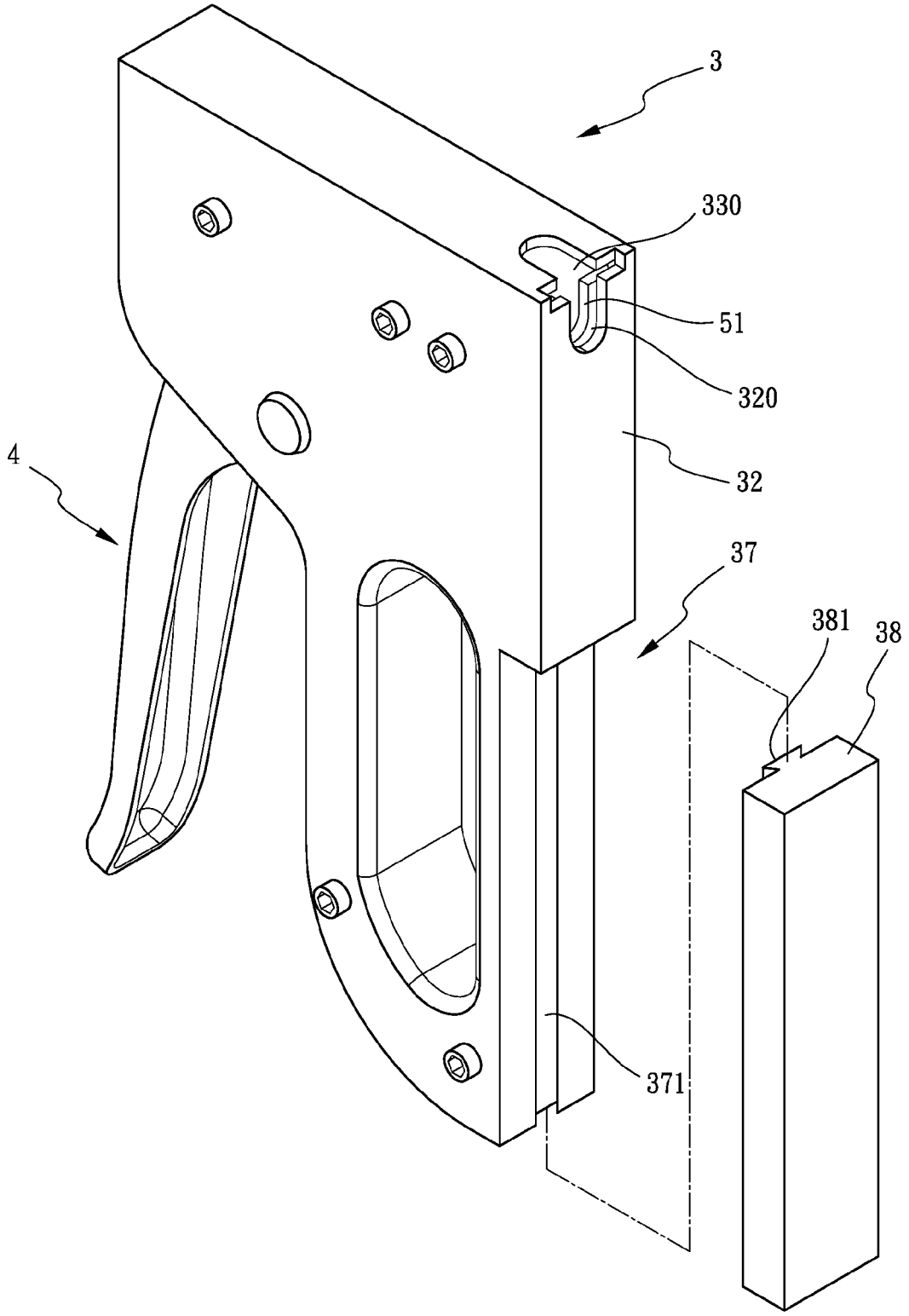
FIG. 8 is a perspective view of a third embodiment of the present invention.
Figure 9:
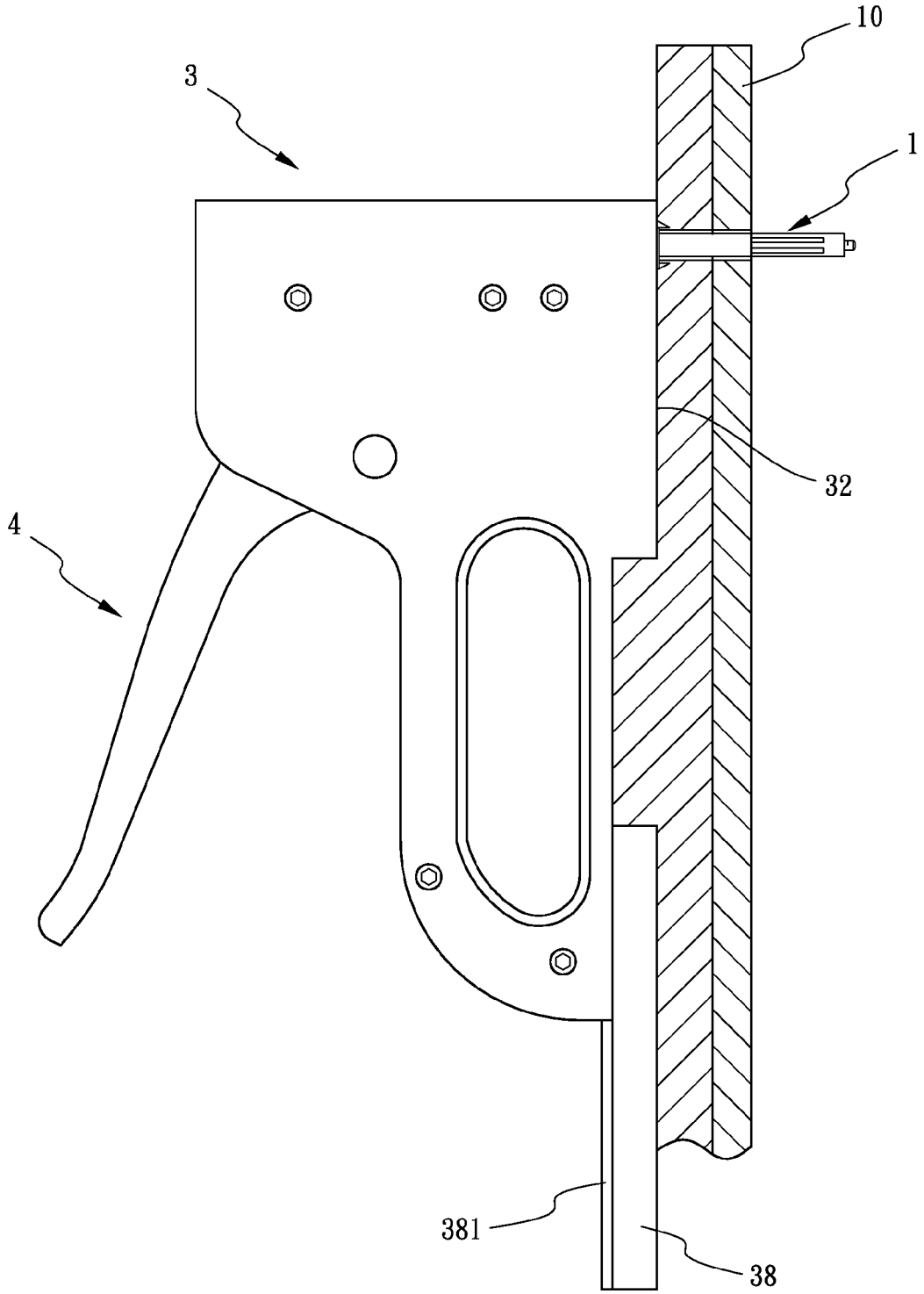
FIG. 9 is a side view of the third embodiment for showing the present invention is abutting against a protruding article.

Referring to FIG. 8 and FIG. 9, the casing 3 has a limiting groove 37 defined on the attaching face 32. The limiting groove 37 has a rail 371 opened at a bottom thereof. A combining block 38 is assembled to the limiting groove 37. The combining block 38 has a combining part 381 protruded thereon. The combining part 381 corresponds to the rail 371, and the combining part 381 is slidably assembled onto the rail 371 so that the combining block 38 is movable relative to the limiting groove 37 via the rail 371 and the combining part 381. Wherein, the protruded portions of a protruding article 10 abuts against the bottom of the limiting groove 37 and the combining block 38 to ensure the user stably operate the present invention on the protruding article 10.

Figure 10:
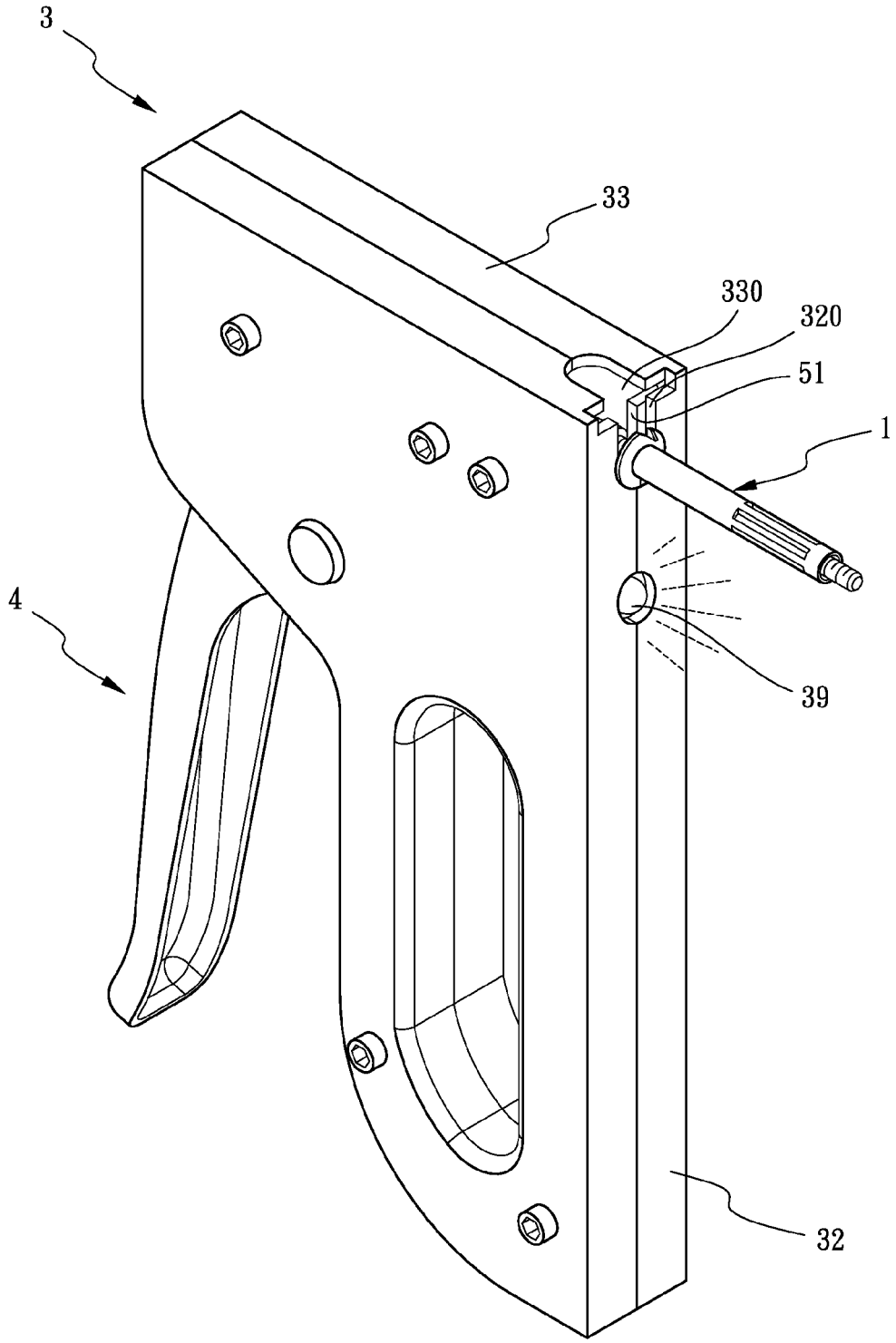
FIG. 10 is a perspective view of a fourth embodiment of the present invention.

Referring to FIG. 10, in order to offer enough brightness for the user to assembled the fastening screw 1 into the positioning opening 330 and to assembled on the pulling member 5, a lightening device 39 is assembled on the casing 3. The lightening device 39 is adjacent to the attaching face 32 and the limiting opening 320 (The method of installing the lightening device 39 and the type of the lightening device 39 are both not limited by the present invention.).

All in all, the present invention has two advantages described as following.

Firstly, the area of the attaching face between the riveter device and the articles 2 is large enough to stably operate the present invention when the attaching face 32 of the present invention is abutted against the articles 2.

Secondly, since the handle bar 4 is pushed from the rear side of the casing 3 toward the front side of the casing 3. In this way, the present invention attaches to the surface of the articles well.

Although the invention has been explained in relation to its preferred embodiment, it is to be understood that many other possible modifications and variations can be made without departing from the spirit and scope of the invention as hereinafter claimed.

What is claimed is:

1. A handy riveter device comprising:

a fastening screw, a casing, a handlebar and a pulling member;

the casing having a left cover and a right cover which are connected to each other, the casing having a receiving space defined therein, the casing having an attaching face defined at a front side thereof, the attaching face having a limiting opening opened at a top end thereof, the casing having a top face defined at a top plane thereof, the top face having a positioning opening at a front end thereof, the limiting opening, the positioning opening and the receiving space communicating with each other, a hole opened on a rear side of the casing, the hole communicating with the receiving space of the casing;

one end of the handlebar assembled into the casing, a pivoting rod passing through the casing and the handlebar so that the handlebar is pivoted on the casing via the pivoting rod, another end of the handlebar extended out from the receiving space via the hole of the casing; and the pulling member slidably assembled into the receiving space, a front end of the pulling member having an engaging groove, the engaging groove corresponding to the limiting opening, a resisting block extruded on a bottom side the pulling member, the resisting block corresponding to one end of the handlebar, one end of the handlebar which is in the receiving space abutting against the resisting block, the receiving spate having an elastomer assembled therein, one end of the elastomer abutting against the pulling member, and another end of the elastomer abutting against an inner wall of the receiving space.

2. The handy riveter device as claimed in claim 1, wherein one end of the handlebar which is assembled in the receiving space is defined as a pushing part; wherein when the pushing part is moved by pushing the handlebar, the pushing part pushes against the resisting block to smoothly move the pulling member backward.

3. The handy riveter device as claimed in claim 1, wherein the pulling member has a receiving room opened at a top side thereof; the receiving room has a stopping block defined therein; one end of the elastomer gets into the receiving room and abuts against the stopping block.

4. The handy riveter device as claimed in claim 1, wherein the receiving space has a torsion spring assembled therein; one end of the torsion spring abuts against the inner wall of the receiving space, and another end of the torsion spring abuts against an inner side of the handlebar.

5. The handy riveter device as claimed in claim 1, wherein two limiting extrusions are respectively protruded from the left cover and the right cover; the two limiting extrusion correspond to the bottom side of the pulling member.

6. The handy riveter device as claimed in claim 1; wherein at least one locking part is defined on a periphery of the casing so that the left cover is combined with the right cover to assemble the casing quickly.

7. The handy riveter device as claimed in claim 1, wherein the casing has a limiting groove defined on the attaching face; the limiting groove has a rail opened at a bottom thereof; a combining block is assembled to the limiting groove; the combining block has a combining part protruded thereon; the combining part corresponds to the rail, and the combining part is slidably assembled onto the rail so that the combining block is movable relative to the limiting groove via the rail and the combining part.

8. The handy riveter device as claimed in claim 1, wherein a lightening device is assembled on the casing; the lightening device is adjacent to the attaching face and the limiting opening.

* * * * *